US007166042B2

(12) United States Patent
Gilbert et al.

(10) Patent No.: US 7,166,042 B2
(45) **Date of Patent: *Jan. 23, 2007**

(54) FORGED IRON-TYPE GOLF CLUBS

(75) Inventors: Peter J. Gilbert, Carlsbad, CA (US); Michael S. Burnett, Carlsbad, CA (US)

(73) Assignee: Acushnet Company, Fairhaven, MA (US)

( * ) Notice: Subject to any disclaimer, the term of this patent is extended or adjusted under 35 U.S.C. 154(b) by 344 days.

This patent is subject to a terminal disclaimer.

(21) Appl. No.: 10/640,534

(22) Filed: Aug. 13, 2003

(65) Prior Publication Data

US 2005/0233832 A1 Oct. 20, 2005

(51) Int. Cl.
*A63B 53/04* (2006.01)

(52) U.S. Cl. ..... 473/350; 473/349; 473/291

(58) Field of Classification Search ..... 473/324–350, 473/290–291

See application file for complete search history.

(56) References Cited

U.S. PATENT DOCUMENTS

| | | | | |
|---|---|---|---|---|
| 4,420,156 | A | 12/1983 | Campau | |
| 4,928,972 | A * | 5/1990 | Nakanishi et al. | 473/332 |
| 4,930,781 | A | 6/1990 | Allen | |
| 4,964,640 | A | 10/1990 | Nakanishi et al. | |
| 5,024,437 | A * | 6/1991 | Anderson | 473/342 |
| 5,154,781 | A * | 10/1992 | Catellier | 148/542 |
| 5,205,560 | A | 4/1993 | Hoshi et al. | |
| 5,263,717 | A * | 11/1993 | McCallister | 473/350 |
| 5,395,113 | A * | 3/1995 | Antonious | 473/324 |
| 5,429,353 | A | 7/1995 | Hoeflich | |
| 5,603,667 | A | 2/1997 | Ezaki et al. | |
| 5,716,288 | A | 2/1998 | Sacco | |
| 5,841,046 | A | 11/1998 | Rhodes et al. | |
| 5,967,903 | A * | 10/1999 | Cheng | 473/342 |
| 6,045,456 | A * | 4/2000 | Best et al. | 473/291 |
| 6,638,183 | B2 * | 10/2003 | Takeda | 473/335 |
| 6,713,717 | B2 | 3/2004 | Takeda | |

OTHER PUBLICATIONS

Mizuno Catalogue, Golf Collection, 2003, pp. cover, 1-4 and 6-9.
Hogan Catalogue, 1992, pp. cover and 4.
www.kensmithgolf.com/irons.htm, The Imperial Collection DB.SS Irons, Nov. 5, 2002, pp. 1-7.

* cited by examiner

*Primary Examiner*—Sebastiano Passaniti
(74) *Attorney, Agent, or Firm*—Kristin D. Wheeler

(57) ABSTRACT

Forged cavity back iron-type clubs and oversize clubs are disclosed. These forged clubs have thin, durable hitting face and relatively large cavity volumes. These clubs have high rotational moments of inertia to minimize distance and accuracy penalties associated with off-center hits. Long irons with hitting face of about 0.100 inch thick are achievable by the present invention. Also disclosed are forged irons made from stainless steels and annealed to achieve the desired hardness and ductility.

27 Claims, 12 Drawing Sheets

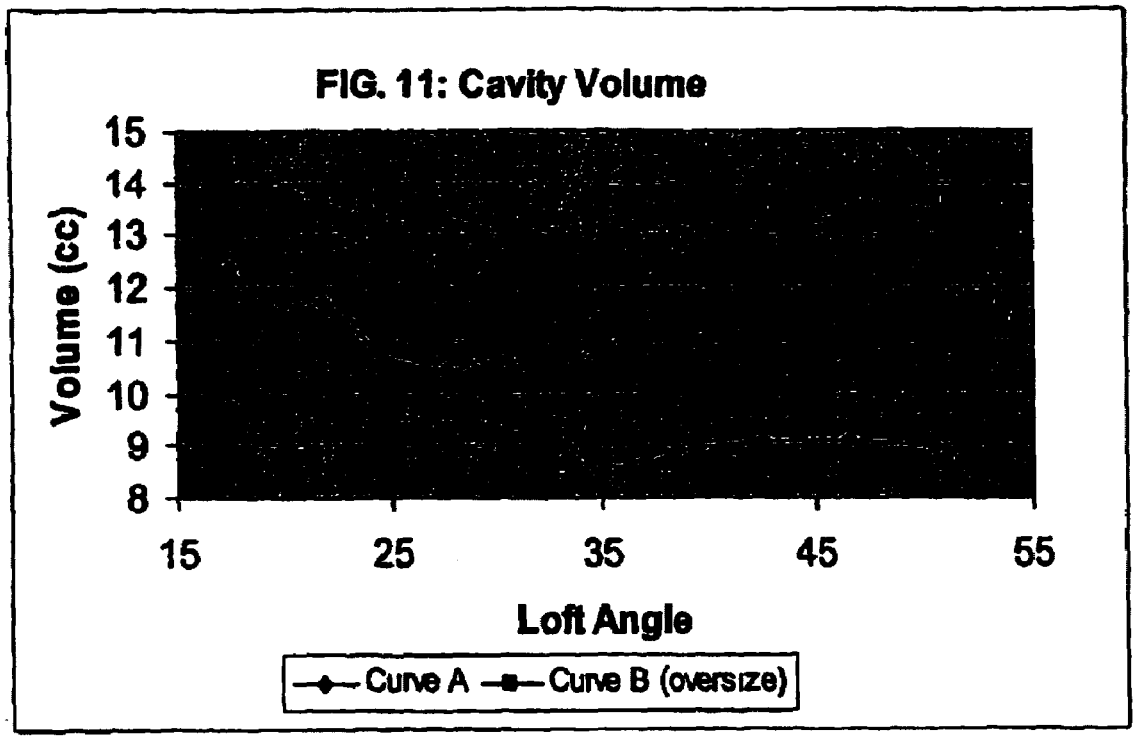
FIG. 11: Cavity Volume
Volume (cc)
15
14
13
12
11
10
9
8
15
25
35
45
55
Loft Angle
Curve A
Curve B (oversize)
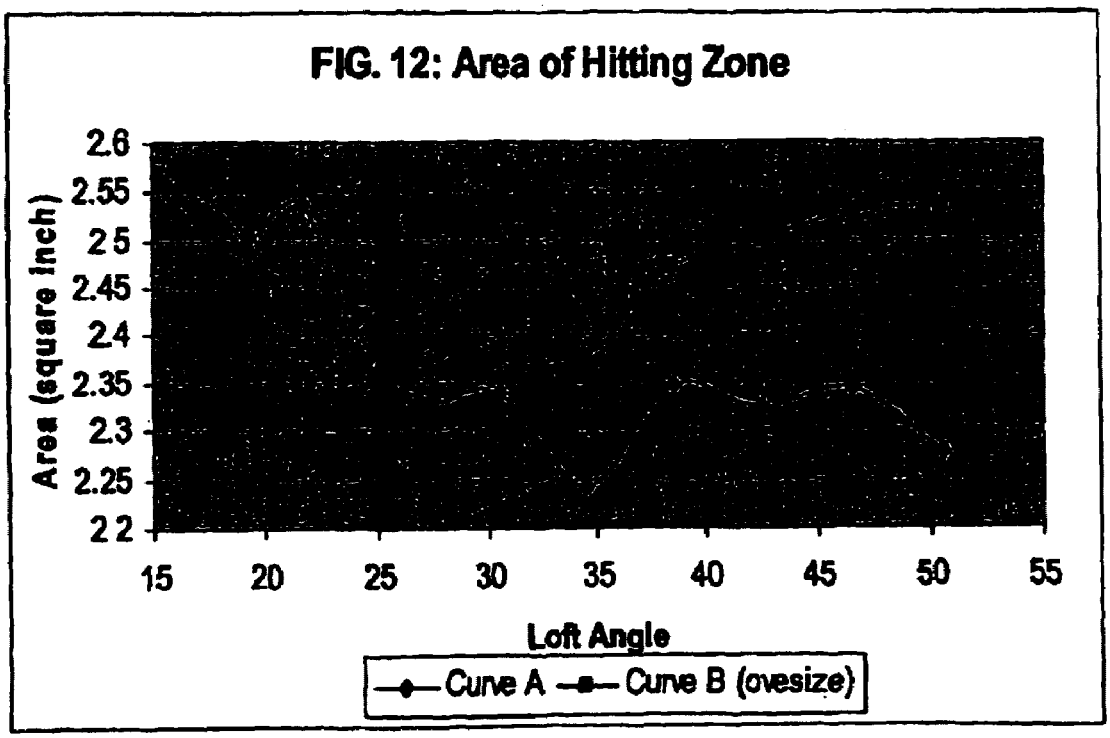
FIG. 12: Area of Hitting Zone
Area (square inch)
2.6
2.55
2.5
2.45
2.4
2.35
2.3
2.25
2.2
15
20
25
30
35
40
45
50
55
Loft Angle
Curve A
Curve B (ovesize)

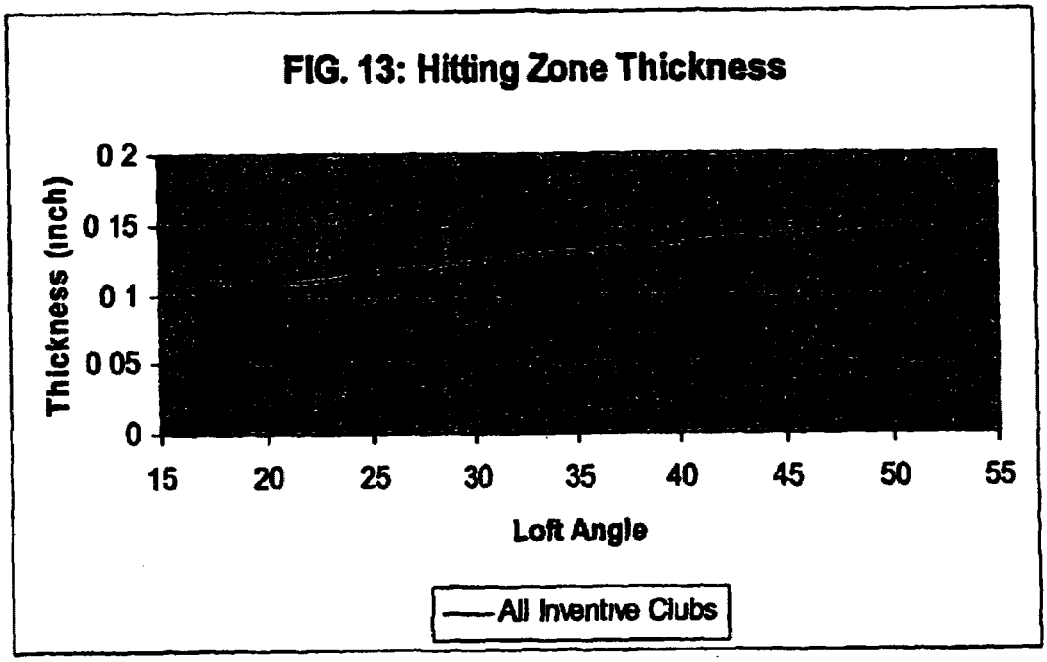
FIG. 13: Hitting Zone Thickness
Thickness (inch)
0 2
0 15
0 1
0 05
0
15
20
25
30
35
40
45
50
55
Loft Angle
All Inventive Clubs
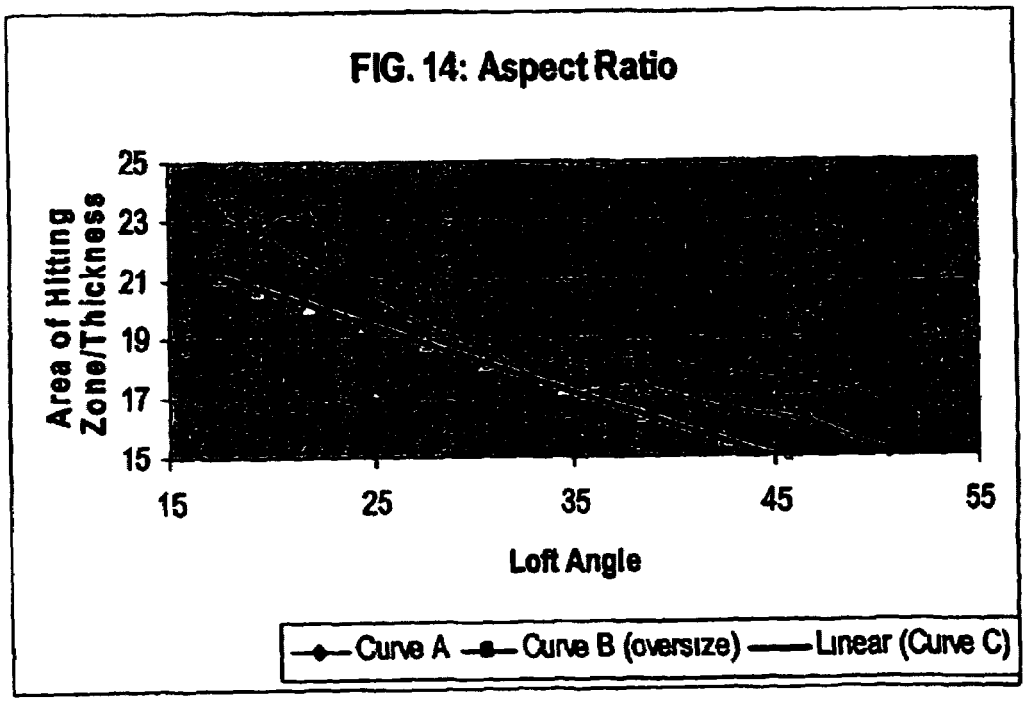
FIG. 14: Aspect Ratio
Area of Hitting Zone/Thickness
25
23
21
19
17
15
15
25
35
45
55
Loft Angle
Curve A
Curve B (oversize)
Linear (Curve C)

FORGED IRON-TYPE GOLF CLUBS

FIELD OF THE INVENTION

This invention generally relates to golf clubs, and, more particularly, to iron-type clubs.

BACKGROUND OF THE INVENTION

Individual iron club heads in a set typically increase progressively in face surface area and weight as the clubs progress from the long irons to the short irons and wedges. Therefore, the club heads of the long irons have a smaller face surface area than the short irons and are typically more difficult for the average golfer to hit consistently well. For conventional club heads, this arises at least in part due to the smaller sweet spot of the corresponding smaller face surface area.

To help the average golfer consistently hit the sweet spot of a club head, many golf clubs are available with cavity back constructions for increased perimeter weighting. Perimeter weighting also provide the club head with higher rotational moment of inertia about its center of gravity. Club heads with higher moment of inertia have a lower tendency to rotate caused by off-center hits. Another recent trend has been to increase the overall size of the club heads, especially in the long irons. Each of these features increases the size of the sweet spot, and therefore makes it more likely that a shot hit slightly off-center still makes contact with the sweet spot and flies farther and straighter. One challenge for the golf club designer when maximizing the size of the club head is to maintain a desirable and effective overall weight of the golf club. For example, if the club head of a three iron is increased in size and weight, the club may become more difficult for the average golfer to swing properly.

In general, the center of gravity of these clubs is moved toward the bottom and back of the club head. This permits an average golfer to get the ball up in the air faster and hit the ball farther. In addition, the moment of inertia of the club head is increased to minimize the distance and accuracy penalties associated with off-center hits. In order to move the weight down and back without increasing the overall weight of the club head, material or mass is taken from one area of the club head and moved to another. One solution has been to take material from the face of the club, creating a thin club face. Examples of this type of arrangement can be found in U.S. Pat. Nos. 4,928,972, 5,967,903 and 6,045,456.

Iron-type clubs, which include wedge clubs, are typically made by investment casting, machining or forging. Forged club heads are coveted by the higher skilled amateur golfers and professionals for its superior playing characteristics. On the other hand, forgeable alloys are malleable and typically have low yield strengths. For forged clubs, the face of the club cannot heretofore be made thin, because of this drawback.

Commercially available forged iron-type clubs are typically the muscle back type, such as the Titleist® Forged 670, 680 and 690 series, Mizuno's MP-33 irons and Kenneth Smith's Royal Signet clubs. The Royal Signet® muscle back clubs concentrate the club weight near the center sweet spot, thereby reducing its moment of inertia. Forged cavity back iron-type clubs are also available, as midsize clubs with relatively thicker hitting face, such as the Titleist® 690-CB, the Hogan Apex Edge Pro or the Royal Signet® Titanium. The Hogan Apex Edge Pro irons are single-piece clubs forged from carbon steel, but the Hogan CFT clubs have a stamped titanium face in a cast body. The Royal Signet® Titanium clubs are cast stainless steel clubs with a forged titanium full face insert for additional strength.

Hence, a need still exists for improved forged iron-type golf clubs.

SUMMARY OF THE INVENTION

Hence, the invention is directed to forged golf clubs.

The present invention is directed to golf clubs wherein the entire club head is forged from metal ingot.

The present invention is also directed to forged iron-type golf clubs.

The present invention is further directed to oversize forged iron-type clubs.

The invention is also directed to an iron-type golf club comprising a club head having a hosel, a front and a back, wherein the back comprises a cavity defined by a perimeter member and the front has a hitting zone located opposite to and coinciding with the cavity. The club head is forged from a malleable metal, such as stainless steel, and then preferably annealed. The cavity and the substantially flat front face form a hitting zone having a first portion and a thicker reinforced portion. The reinforced portion is preferably located below the first portion and may have one or more depressions defined therein. The thickness of the reinforced portion is about 1.2 times to about 3 times higher than the thickness of the first portion.

The first portion occupies from about 50% to about 90% of the total area of the hitting zone, and more preferably from about 60% to about 80% of the total area of the hitting zone. The perimeter member is preferably thicker on the bottom of the club head than on the top.

The present invention is also directed to an iron-type golf club comprising a club head made from single-piece or multiple-piece forged stainless steel. The club head comprises a hosel a front and a back defining a cavity, and the front comprises a hitting zone located opposite to the cavity and is defined by the cavity area. The cavity has a volume equal to or greater than about 10 cc. A set of inventive irons has cavity volumes defined as greater than or equal to curve A in FIG. 11. More preferably the cavity volume through a set is greater than or equal to curve B in FIG. 11. Preferably, the forged stainless steel is annealed after forging.

The present invention is further directed to an iron-type golf club comprising a club head made from forged metal, said club head comprises a hosel, a front and a back defining a cavity, wherein the front comprises a hitting zone located opposite to and coinciding with the cavity and wherein the hitting zone has an area equal to or greater than about 2.25 $inch^2$ and the cavity has a volume equal to or greater than about 9 cc. A preferred set of such irons has an average hitting zone equal to or greater than about 2.25 $inch^2$ and average cavity volume equal to or greater than about 9 cc. More preferably, the hitting zone is equal to or greater than about 2.4 $inch^2$ and average cavity volume equal to or greater than about 12 cc.

The present invention is further directed to an iron-type golf club comprising a club head made from forged metal, said club head comprises a front face and a back defining a cavity, wherein the front face comprises a hitting zone opposite to the cavity and the hitting zone has a minimum thickness less than about 0.2 inch for the set. More preferably, the thickness is less than about 0.13 inch for clubs having loft angles (LA) less than about 30°.

The present invention is further directed to an iron-type golf club comprising a club head made from forged metal, said club head comprises a hosel, a front and a back defining a cavity, wherein the front comprises a hitting zone located opposite to and coinciding with the cavity and wherein the hitting zone has an ratio (R) defined by the following equation:

$$R \geqq -((1/4.5) \times LA) + 25,$$

wherein the ratio is defined as the area of the hitting zone divided by its minimum thickness.

The malleable or forged metal is preferably stainless steel having yield strength of less than or equal to 90,000 psi and over about 13% in elongation. More preferably, the material has yield strength of less than about 85,000 psi and ultimate elongation of about 15% to about 21%. The forged metal preferably contains more than 10% chromium (Cr).

The iron-type golf club head can be any of the number 1–9 irons, the pitching wedge, the sand wedge and the gap wedge.

BRIEF DESCRIPTION OF THE DRAWINGS

In the accompanying drawings, which form a part of the specification and are to be read in conjunction therewith and in which like reference numerals are used to indicate like parts in the various views:

FIG. 11 is a graph showing the cavity volume of the club heads in accordance with the present invention;

FIG. 12 is a graph showing the areas of the hitting zones of the club heads in accordance with the present invention;

FIG. 13 is a graph showing the exemplary minimum thickness of the hitting zones of the club heads in accordance with the present invention;

FIG. 14 is a graph showing the ratios between the areas of the hitting zones of FIG. 12 and the minimum thickness of FIG. 13.

DETAILED DESCRIPTION OF THE PREFERRED EMBODIMENTS

Figure 1:
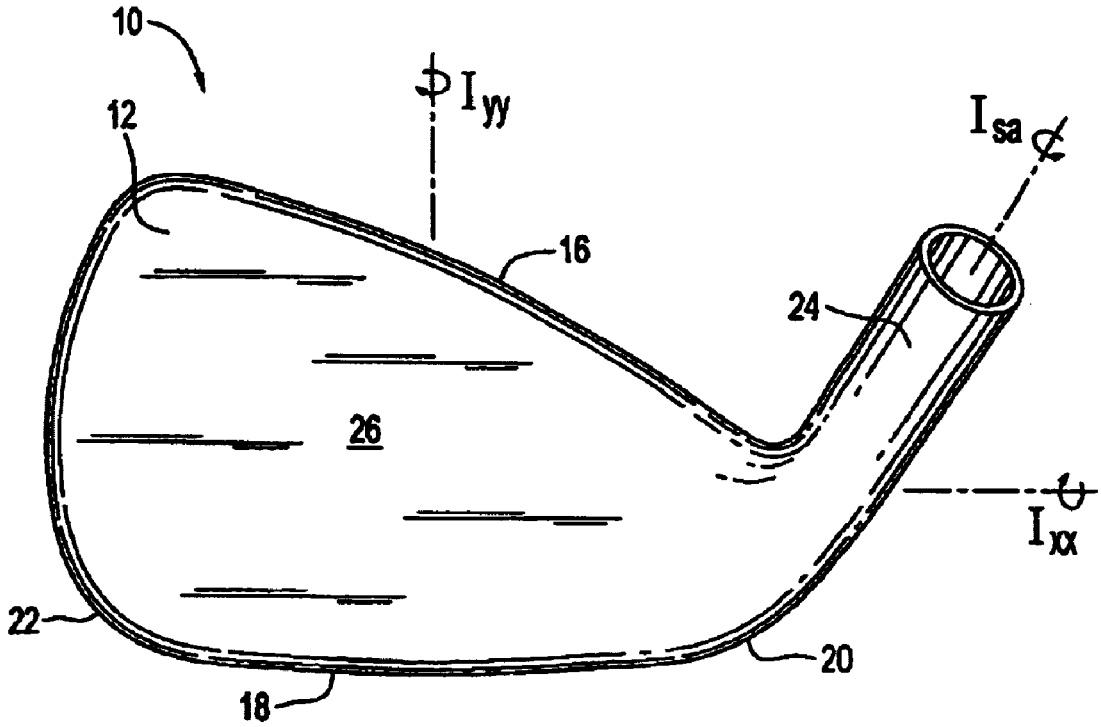
FIG. 1 is a front view of a club head in accordance with an embodiment of the present invention, with the grooves omitted for clarity.
Figure 2:
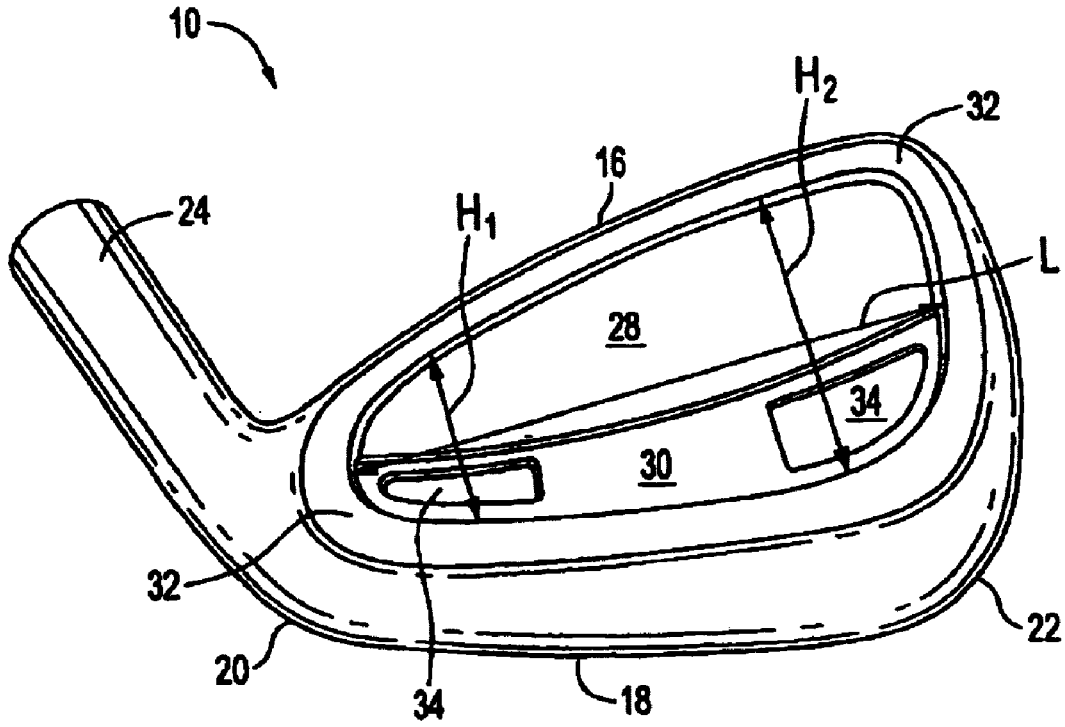
FIG. 2 is a back view of the club head of FIG. 1.
Figure 3:
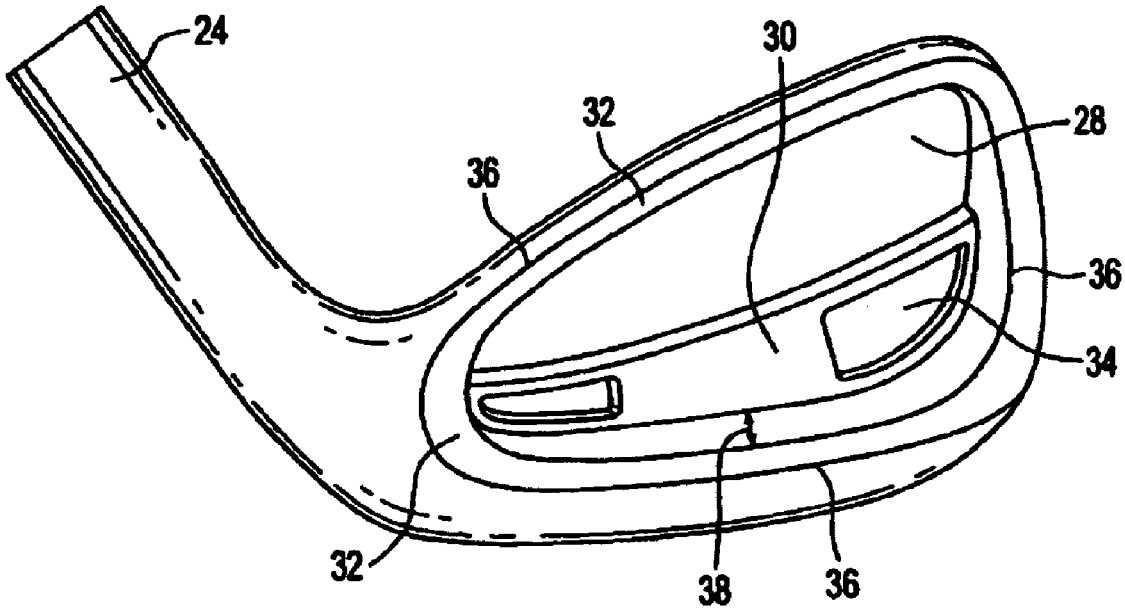
FIG. 3 is an isometric back view of the club head of FIG. 1.

Club head 10 in accordance with an embodiment of the present invention is illustrated in FIGS. 1–7. Club head 10 comprises front 12, back 14, top 16, sole 18, heel 20, toe 22 and hosel 24. The club head is a single-piece forging, i.e., it is forged from a single ingot and does not include a face insert, or it is formed from a stainless steel body and stainless steel insert. The body is forged and the face insert is forged or stamped. A shaft (not shown) is connected to the club head at hosel 24 and a grip (not shown) is provided at the top end of the shaft. The grooves on the front 12 are omitted from the figures for clarity. Front 12 comprises hitting zone 26, which preferably is defined by the rear cavity area and is located opposite to top portion 28 and reinforced portion 30 as best illustrated in FIGS. 2 and 3. Club head 10 is a "cavity back" club, i.e., a substantial portion of the mass of the club head is positioned on the back side around perimeter 32 of the club head. As explained further below, the cavity back design provides the club with larger rotational moments of inertia to resist the club's tendency to rotate caused by off-center hits. Inside perimeter 32, top portion 28 is the thinnest member of hitting zone 26. The minimum thickness of front 12 is in top portion 28. Reinforced portion 30 is thicker than top portion 28 to provide some structural support to the hitting face. Taken together, top portion 28 and reinforced portion 30 resemble a traditional "muscle-back" forged club. Club head 10 also has a distinctive appearance of having a muscle-back within a cavity back. Reinforced portion 30 may have depressions 34 to provide the club with more distinctiveness.

Figure 4:
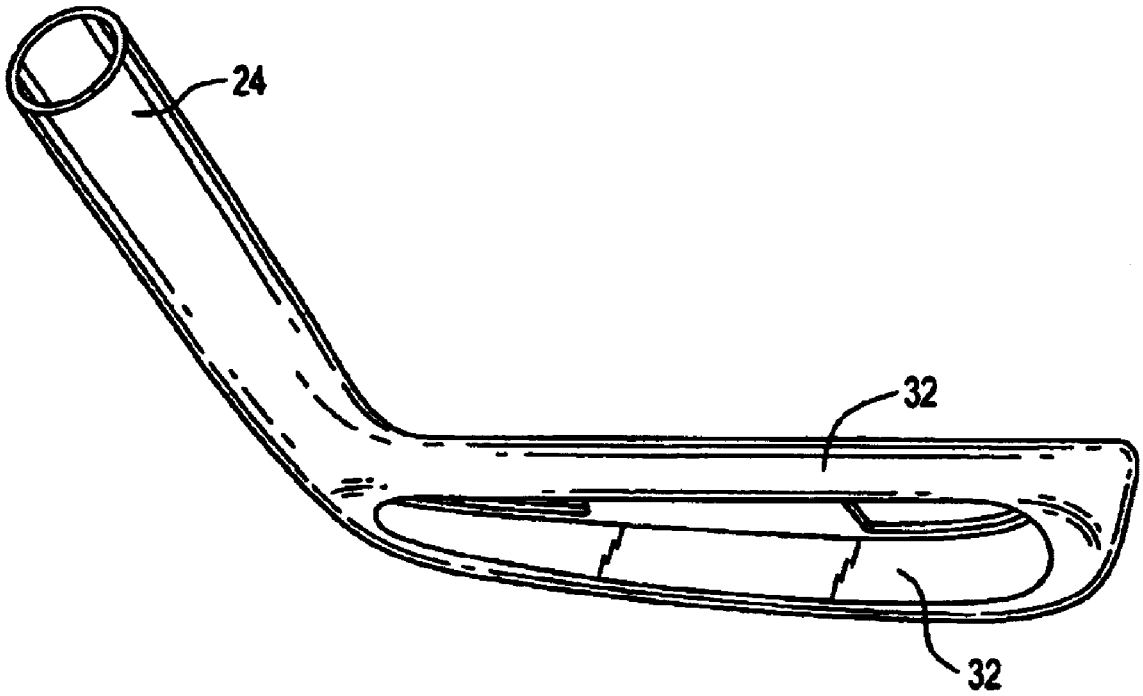
FIG. 4 is a top view of the club head of FIG. 1.
Figure 5:
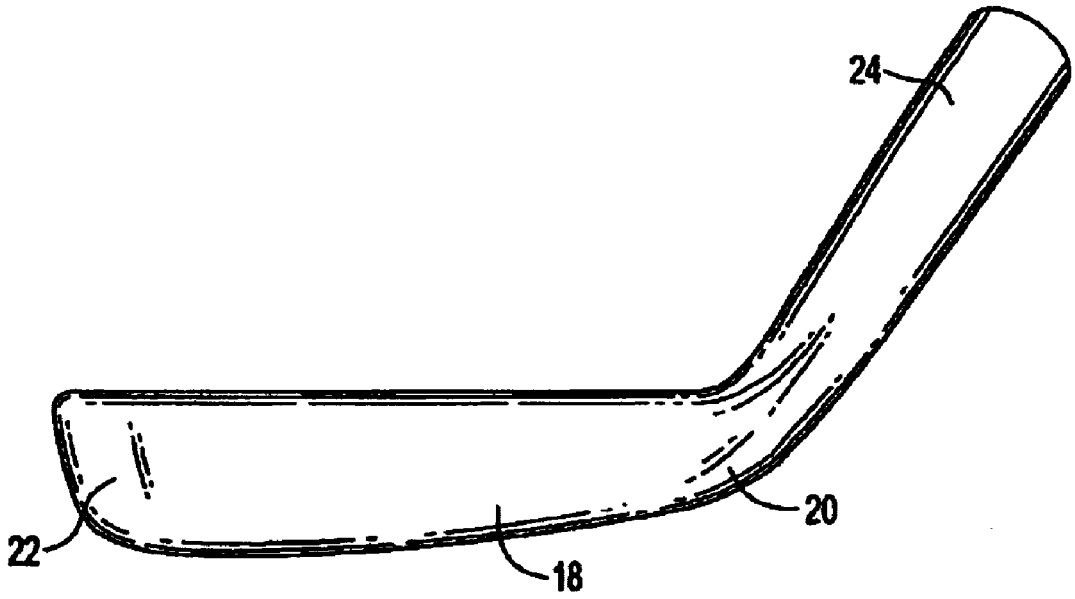
FIG. 5 is a sole view of the club head of FIG. 1.
Figure 6:
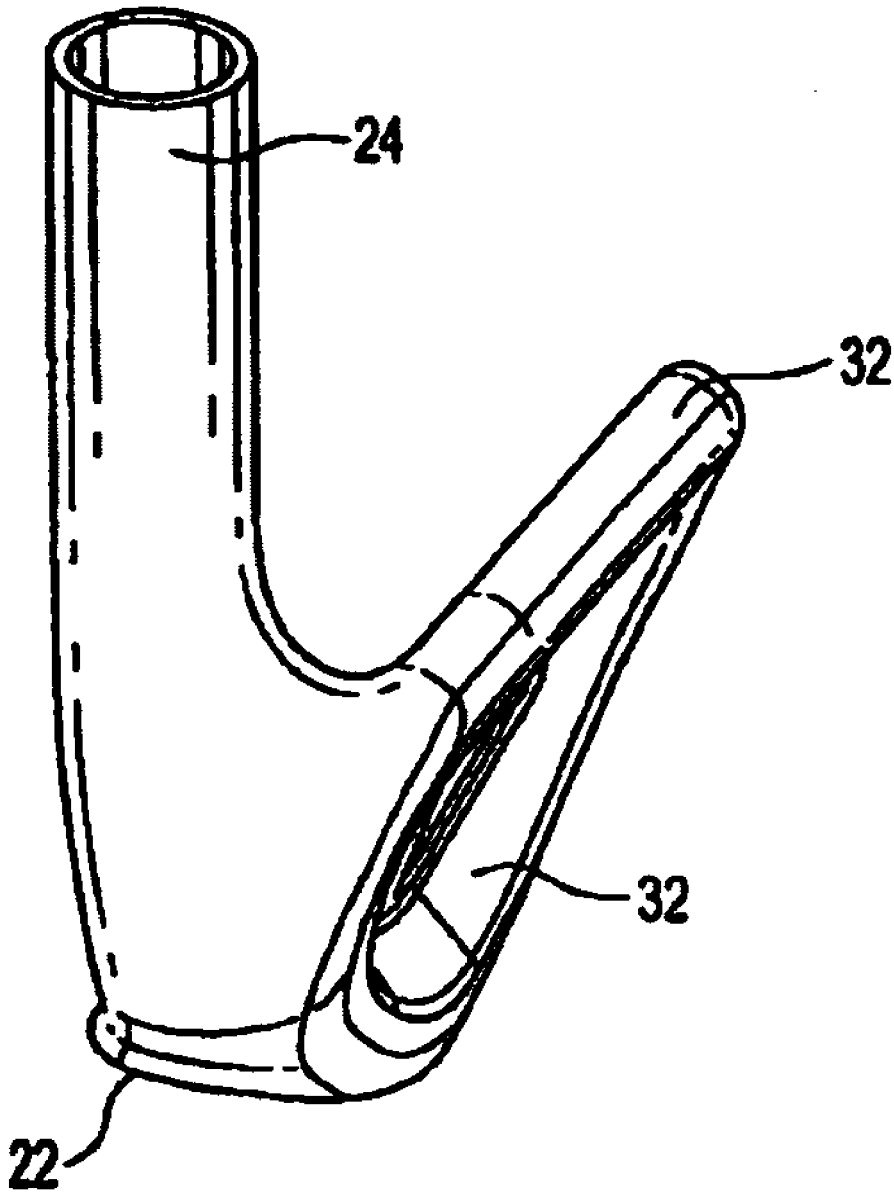
FIG. 6 is a heel view of the club head of FIG. 1.
Figure 7:
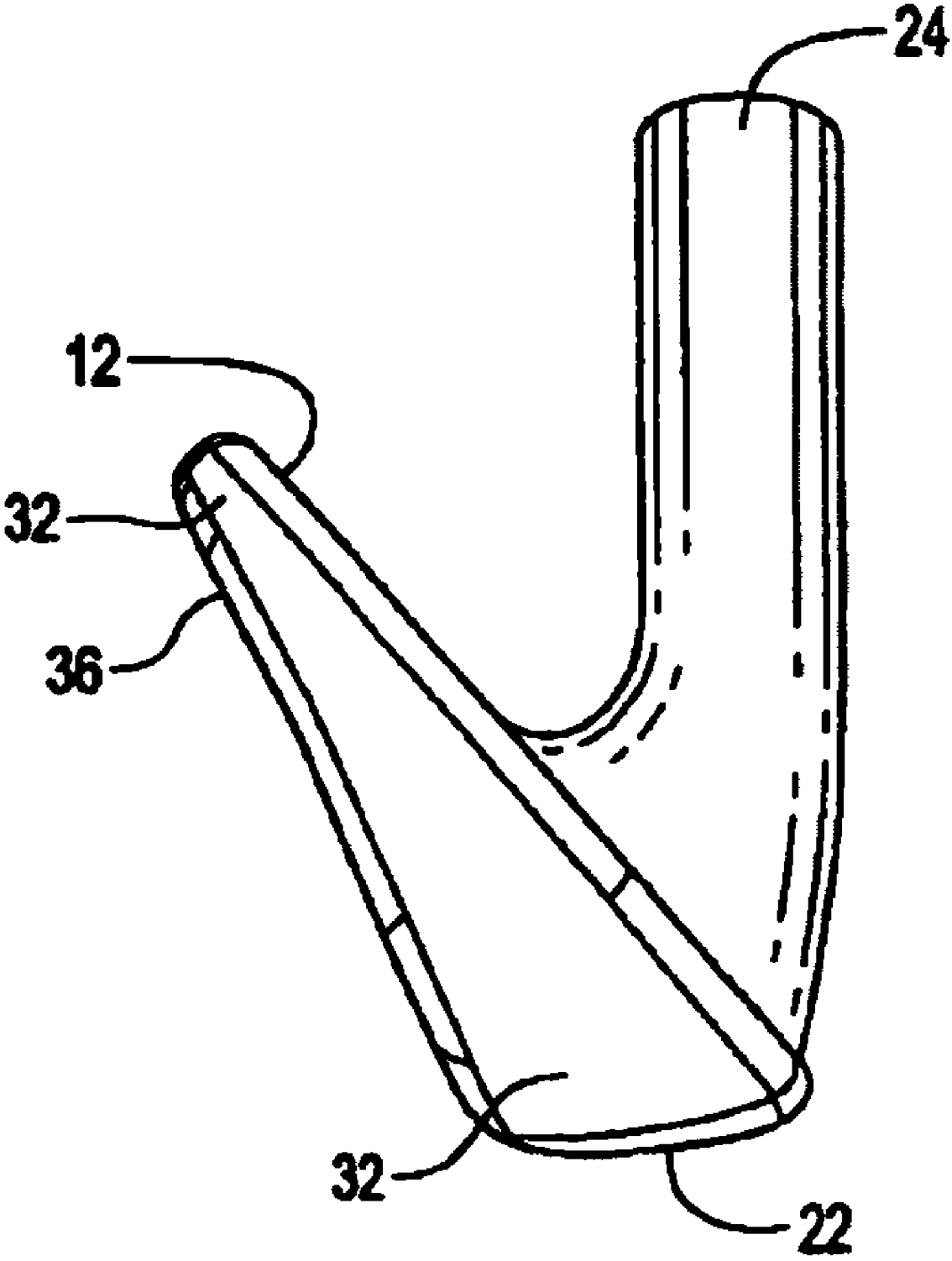
FIG. 7 is a toe view of the club head of FIG. 1.

Additionally, the mass distribution within perimeter 32 is biased toward sole 18, so that the center of gravity of club head 10 is both behind and below the geometric center of the face. The geometric center can be defined as the intersection of a vertical centerline and a horizontal centerline of front 12, or it can be defined as the midpoint of the grooves. As best illustrated in FIGS. 3, 4 and 7, the thickness at the top of perimeter 32 is substantially thinner than the thickness at the bottom of perimeter 32. When the center of gravity is below and behind the geometric center of the hitting face, the club can launch the golf ball to higher trajectory and longer flight distance.

Figure 8:
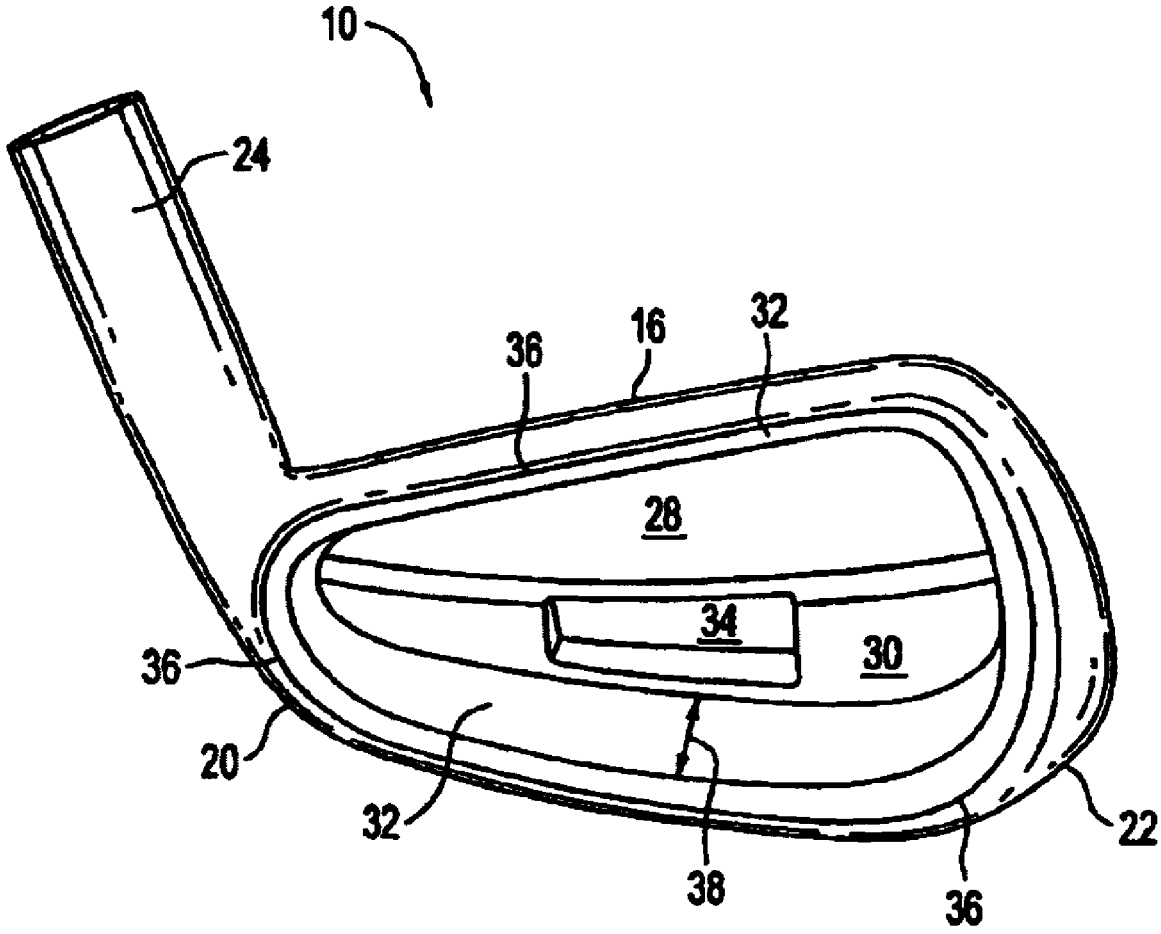
FIG. 8 is an isometric back view of a club head in accordance with another embodiment of the present invention.
Figure 15:
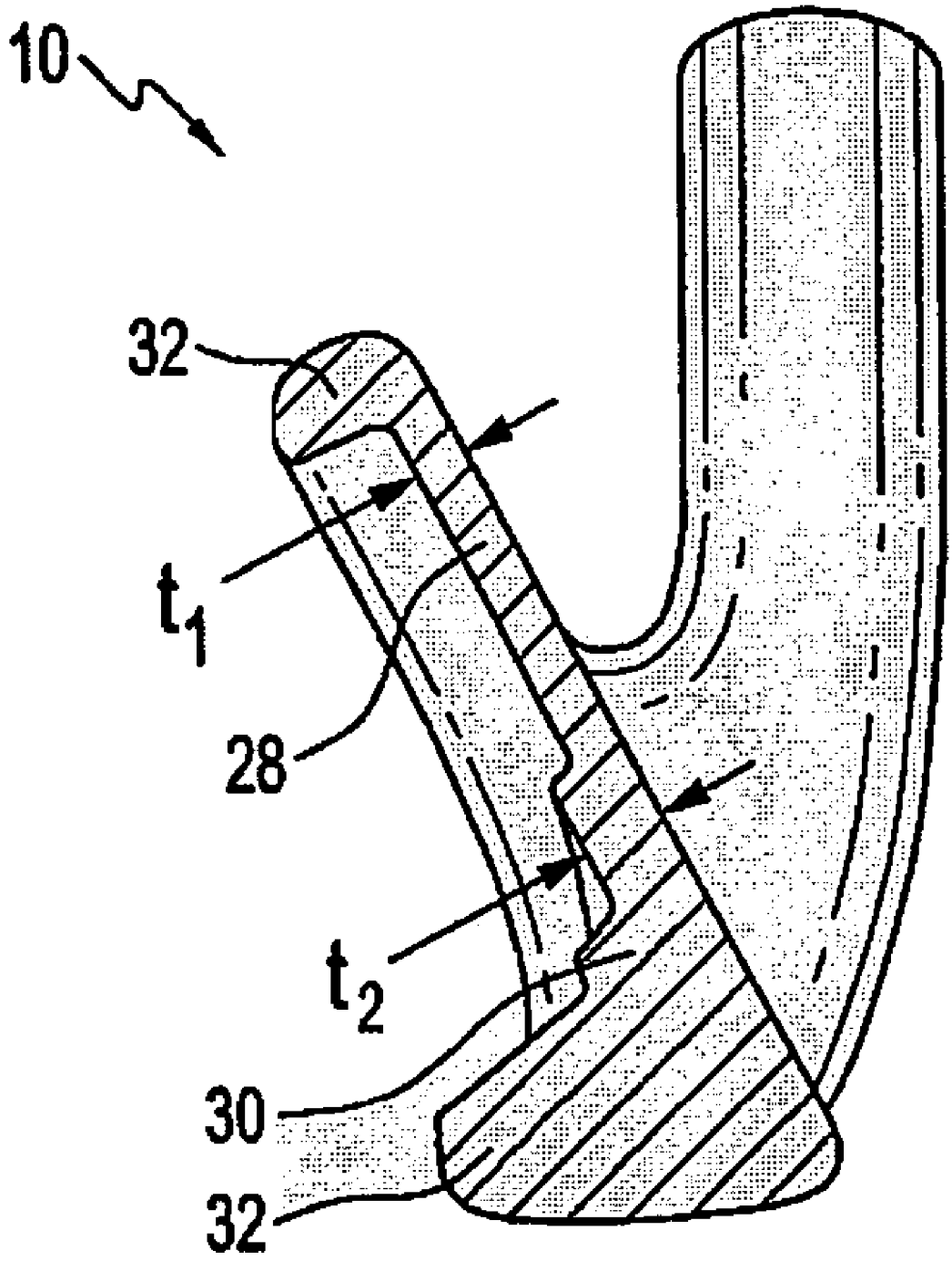
FIG. 15 is a cross-sectional view of the club of FIG. 8.

Another embodiment of the present invention is illustrated in FIG. 8. This embodiment is substantially similar to the embodiment of FIGS. 1–7, except that this club head is an "oversize" club head. As used herein, oversize club head includes, but is not limited to, club heads that are dimensionally larger than the traditional club heads, club heads that have larger "sweet-spots" than traditional club heads, and cavity back club heads that have a relatively higher cavity volume. Cavity volume is defined as the volume within a three-dimensional shape bounded by the surface of the back of hitting zone 26, i.e., the combined surfaces of portions 28 and 30, the inner surface of perimeter weight 32 and an imaginary planar or curvilinear plane formed by outer edge 36 of perimeter 32. Outer edge 36 is best illustrated in FIG. 7. The club head of FIG. 8 is the oversize version of the club head of FIGS. 1–7, because of the relative difference in cavity volumes. This cavity volume difference is best illustrated by the relative difference in thickness 38 of perimeter 32 shown in FIG. 3 and in FIG. 8. FIG. 15 illustrates a cross-sectional view of this club showing minimum thickness $t_1$ of top portion 28 and thickness $t_2$ of reinforced portion 30.

The table below shows the preferred cavity volumes for the clubs in accordance with the present invention:

| Club | Inventive Clubs | | Inventive Oversize Clubs | |
|---|---|---|---|---|
| Type | Loft° | Cavity Volume ($cm^3$) | Loft° | Cavity Volume ($cm^3$) |
| 1 | 17.5 | 12.36 | | |
| 2 | 19.5 | 11.58 | 19.0 | 14.1 |
| 3 | 22.0 | 11.75 | 21.5 | 13.62 |

-continued

| Club | Inventive Clubs | | Inventive Oversize Clubs | |
|---|---|---|---|---|
| Type | Loft° | Cavity Volume ($cm^3$) | Loft° | Cavity Volume ($cm^3$) |
| 4 | 25.0 | 10.78 | 24.0 | 13.35 |
| 5 | 28.0 | 10.45 | 27.0 | 13.31 |
| 6 | 31.0 | 10.64 | 30.0 | 13.05 |
| 7 | 35.0 | 8.68 | 34.0 | 13.18 |
| 8 | 39.0 | 8.92 | 38.0 | 13.24 |
| 9 | 43.0 | 9.10 | 42.0 | 13.05 |
| PW | 47.0 | 9.09 | 46.0 | 13.37 |
| SW | 51.0 | 8.96 | 50.0 | 13.66 |

The cavity volumes for these two embodiments of club head 10 are plotted in FIG. 11 as a function of the loft angle of the club head. As depicted in FIGS. 11, 13 and 14, curve A depicts the characteristics of the inventive clubs and curve B depicts the characteristics of the inventive oversize clubs. FIG. 11 readily shows that the cavity volume for the oversize clubs is always larger than the cavity volume for the other clubs. Furthermore, for clubs with loft angle (LA) less than about 32°, the cavity volume is greater than about 10 $cm^3$ (cc). The cavity volume is at least about 8 cc for all clubs. For the oversize clubs, the cavity volume is at least about 12 cc for all clubs, and preferably the cavity volume is greater than about 13 cc. Additionally, as discussed below, the larger cavity volumes of the inventive oversize clubs produce the desirable high rotational moment of inertia.

In accordance with one aspect of the present invention, malleable stainless steel is a preferred material for the forging process. Typically carbon steel had been used for forging due to its softness. However, because carbon steel rusts, the club head is chrome plated for protection. Chrome plating is not ductile and thus subject to cracking. This limits the lie, loft and bending ability of the club head. Chrome plating also limits the ability of golf club manufacturers to grind the finished head to customize weight, shape and/or sole configuration, since the thin chrome plating would be eliminated.

Preferred stainless steels have yield strength of less than about 90,000 psi and over about 13% in elongation. More preferably, the material has yield strength of less than about 85,000 psi and ultimate elongation of about 15% to about 21%. Preferred stainless steels also have a Rockwell Hardness of less than about 25 HRC (Hardness Rockwell C scale). Suitable stainless steels include the 410 stainless steel, which has the following chemical composition: 86.98% Fe, 11.3% Cr, 0.723% Mn, 0.366% Si, 0.297% Ni, 0.11% C, 0.034% P, 0.033% Cu, 0.03% Mo, 0.02% V, 0.017% S, and 0.01% Al. Another suitable stainless steel is the 403 stainless steel, which has the following chemical composition: 86% Fe, 12.3% Cr, max 1% Mn, max 0.5% Si, max 0.15% C, max 0.04% P and max 0.03% S.

A forged club head made from 410 stainless steel has a hardness in the range of about 14.2 to about 17.3 HRC. The forging process may comprise multiple forging steps, wherein each forging step is followed by other processing steps such as grinding, sandblasting, removing flash, and trimming, among others. For example, the forging process may have a primer forging step followed by grinding and/or sandblasting before multiple rough forging steps are carried out. More grinding and sandblasting can occur before the grooves are cut or stamped and fine forging steps are performed to finish the forging process.

In accordance with another aspect of the present invention, the forged club head is further treated by annealing (heating) to decrease its hardness to less than about 40 HRC and preferably less than about 90 HRB, more preferably about 80 HRB. In one embodiment, the hardness is annealed to between 20–40 HRC for durability. In a preferred embodiment, the club is made softer for customization and has a hardness less than about 90 HRB. In one example, the forged club head is heated to about 1050° C. for about 90 minutes and then to about 650° C. for about 120 minutes.

The post-forging heat treatment brings the hardness of the forged club head to any desired hardness. Advantageously, the increased hardness resolves the problem of the forged club head being too hard and being easily customized in loft and lie. The hardness of the annealed forged material is also advantageously in the same range as the hardness of the cast materials, e.g., cast 431 stainless steel or cast 8620 carbon steel, used in the high-end cast clubs, such as Titleist® DCI irons. The physical properties of these materials are shown below:

| Material | Density | Hardness | Tensile Strength (Ultimate) | Tensile Strength (Yield) | Elongation |
|---|---|---|---|---|---|
| 410 SS (forged & annealed) | 7.72 g/cm | 24 HRC-77 HRB | 97,000 psi | 70,000 psi | 16% |
| 403 SS (forged & annealed) | | | (same as 410 SS) | | |
| 416 SS (machined) | 7.64 | 21 HRC | 107,000 | 81,900 | 20% |
| 431 SS (cast) | 7.67 | 20–28 HRC | 95,000 | 60,000 | 18% |
| S20C (forged) | 7.87 | 85–95 HRB | 80,000 | 55,000 | 20% |
| 8620 (cast) | 7.75 | 85–90 HRB | 85,000 | 60,000 | 20% |

Hence, the present invention resolved the thick hitting face problem of forged irons by selecting a ductile or malleable forgeable stainless steel that is better than chrome-plated soft carbon steel and annealing the forged club head.

Figure 9A:
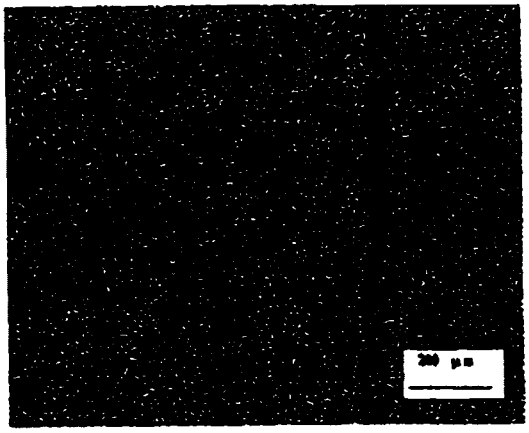
FIG. 9(*a*) and 9(*b*) are magnified photographs of the microstructure of a forged material suitable for use in the club heads of the present invention.
Figure 9B:
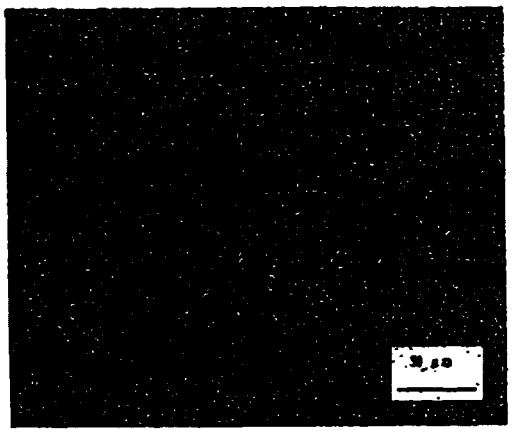
Figure 10A:
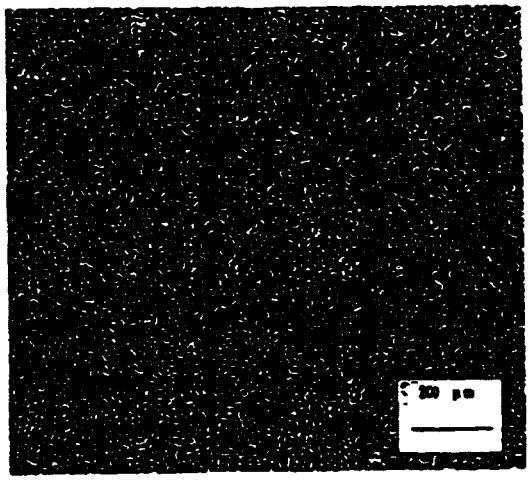
FIG. 10(*a*) and 10(*b*) are magnified photographs of the microstructure of the forged material of FIGS. 9(*a*) and 9(*b*) after annealing.
Figure 10B:
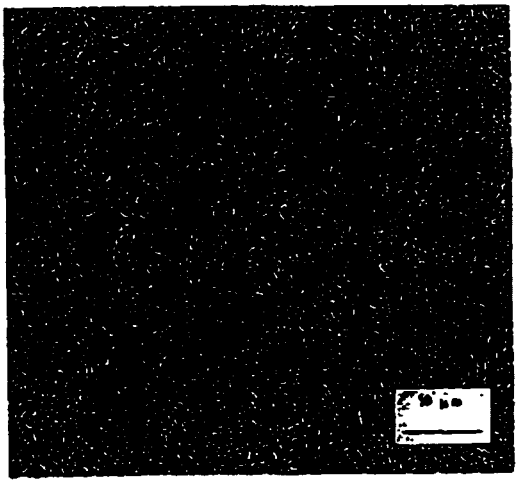

Another advantage realized by the annealing step is that the crystalline structure of the forged material improved. As illustrated in FIGS. 9(*a*) and 9(*b*), the microstructure of the forged club head comprises relatively small grain size, and as shown in FIGS. 10(*a*) and 10(*b*) the grain size has significantly increased. Metals with larger grain size microstructure have higher ductility. Preferably, the grain size is greater than about 10 μm to about 50 μm. As shown in the above table, the ductility of annealed and forged 410 SS has elongation properties approaching that of cast 431 SS. The chemical composition for 431 stainless steel is 82% Fe, 15–17% Cr, 1.25%–2.5% Ni, max 1% Mn, max 1% Si, max 0.2% C, max 0.04% P and max 0.03% S.

Additionally, the bending ability of forged and annealed 410 SS surpassed 17-4 PH SS, another commonly used metal for iron-type clubs and similar to cast 431 SS. Other suitable materials include, but are not limited to, forgeable 403 SS, 431 SS, 416 SS, 303 SS, 304 SS, 329 SS, 316 SS, 259 SS, Nitronic 40, Nitronic 50 and Nitronic 60. Suitable stainless steels have at least 10% Cr. The forging and annealing processes can readily be adjusted to reach the desirable hardness, tensile strength and ductility in accordance with the process described above.

The inventive iron-type clubs can have a hitting zone minimum thickness in the same range as the thickness of cast iron-type clubs. In one embodiment, the thickness of hitting zone 26 can be less than about 0.100 inch. The inventors of the present invention have produced clubs with a hitting zone as thin as about 0.098 inch for the long irons, i.e., the no. 1, 2 and 3 irons. In other embodiments, particularly in the two-piece embodiment, i.e., a forged body and a forged or stamped insert, the thickness can be as low as 0.060 inch.

The minimum thickness of hitting zone 26 can be characterized in terms of the clubs' ratio, which is the ratio of hitting zone 26 over its minimum thickness. Referring to FIG. 2, the area of hitting zone 26 within front 12 is estimated as the product of the length L of hitting zone 26 and the average height of hitting zone 26. Two representative heights, $H_1$ and $H_2$, are illustrated. In other words, hitting zone 26 is the area within front 12 opposite to and coinciding with top portion 28 and reinforced portion 30 of the cavity back. The minimum thickness $t_1$ is measured within top portion 28. The defined aspect ratio covers hitting zone 26, where the area of top portion 28 makes up from about 50% to about 90%, more preferably from 60% to about 80%, of the total area of hitting zone 26. The thickness of reinforced portion 30 can be about 1.2 times to about 3 times the thickness of top portion 28. The relative thickness between top portion 28, $t_1$, and reinforced portion 30, $t_2$, is illustrated in FIG. 15.

| | Inventive Clubs | | | | |
|---|---|---|---|---|---|
| Club Type | Loft° | Face Area of Front 12 (inch$^2$) | Hitting Zone 26 (inch$^2$) | Thickness (inch) | Ratio (inch) |
| 1 | 17.5 | 4.165 | 2.548 | 0.110 | 23.16 |
| 2 | 19.5 | 4.185 | 2.503 | 0.110 | 22.75 |
| 3 | 22.0 | 4.202 | 2.538 | 0.110 | 23.07 |
| 4 | 25.0 | 4.231 | 2.373 | 0.115 | 20.63 |
| 5 | 28.0 | 4.216 | 2.330 | 0.120 | 19.42 |
| 6 | 31.0 | 4.317 | 2.338 | 0.125 | 18.70 |
| 7 | 35.0 | 4.379 | 2.240 | 0.130 | 17.23 |
| 8 | 39.0 | 4.545 | 2.346 | 0.135 | 17.38 |
| 9 | 43.0 | 4.660 | 2.323 | 0.140 | 16.59 |
| PW | 47.0 | 4.755 | 2.345 | 0.145 | 16.17 |
| SW | 51.0 | 4.800 | 2.277 | 0.150 | 15.18 |

| | Inventive Oversize Clubs | | | | |
|---|---|---|---|---|---|
| Club Type | Loft° | Face Area of Front 12 (inch$^2$) | Hitting Zone 26 (inch$^2$) | Thickness (inch) | Ratio (inch) |
| 2 | 19.0 | 4.258 | 2.506 | 0.110 | 22.78 |
| 3 | 21.5 | 4.322 | 2.363 | 0.110 | 21.48 |
| 4 | 24.0 | 4.304 | 2.421 | 0.115 | 21.05 |
| 5 | 27.0 | 4.383 | 2.466 | 0.120 | 20.55 |
| 6 | 30.0 | 4.391 | 2.377 | 0.125 | 19.02 |
| 7 | 34.0 | 4.476 | 2.377 | 0.130 | 18.28 |
| 8 | 38.0 | 4.644 | 2.471 | 0.135 | 18.30 |
| 9 | 42.0 | 4.750 | 2.498 | 0.140 | 17.84 |
| PW | 46.0 | 4.864 | 2.528 | 0.145 | 17.43 |
| SW | 50.0 | 4.920 | 2.535 | 0.150 | 16.90 |

As used herein, club nos. 1–9, pitching wedge (PW) and sand wedge (SW) have common accepted descriptions used in the golf club art. A set of irons typically includes clubs ranging from 3-iron to PW or 5-iron to PW with other clubs being available for custom orders. It is also noted that a manufacturer can make different clubs within a set in different manners, such as cavity back/muscle back sets. Iron-type clubs may also include a gap wedge. These clubs can also be described by other variables including, but not limited to, the loft angle. The areas of hitting zone 26 are plotted in FIG. 12, the minimum thicknesses of top portion 28 are plotted in FIG. 13 and the ratios between the areas of hitting zone 26 and minimum thickness are plotted in FIG. 14. In FIGS. 12 and 14, Curves A illustrate the areas of hitting zone 26 and the ratios for the inventive clubs and Curves B illustrate the areas of hitting zone 26 and ratios for the inventive oversize clubs.

FIG. 12 illustrates large hitting zones for the inventive clubs and for the inventive oversize clubs, which are the results of having large face areas combined with large cavity volumes. FIG. 13 illustrates the thin single-piece stainless steel forged face having a minimum thickness of less than or equal to about 0.200 inch, and preferably the less than about 0.130 inch for clubs with LA of less than about 35°. FIG. 14 shows the ratios (R) of the clubs of the present invention, and the advantages of having a large hitting area and a thin face. The R can be expressed as $$R \geqq -((1/4.5) \times LA) + 25.$$

Curve C is the linear line representing this equation in FIG. 14.

Rotational moment of inertia ("inertia") in golf clubs is well known in art, and is fully discussed in many references, including U.S. Pat. No. 4,420,156, which is incorporated herein by reference in its entirety. When the inertia is too low, the club head tends to rotate excessively from off-center hits. Higher inertia indicates higher rotational mass and less rotation from off-center hits, thereby allowing off-center hits to fly farther and closer to the intended path. Inertia is measured about a vertical axis going through the center of gravity of the club head ($I_{yy}$), and about a horizontal axis about the center of gravity (c.g.) of the club head ($I_{xx}$), as shown in FIG. 1. The tendency of the club head to rotate around the y-axis through the c.g. indicates the amount of rotation that an off-center hit away from the y-axis causes. Similarly, the tendency of the club head to rotate in the around the x-axis through the c.g. indicates the amount of rotation that an off-center hit away from the x-axis through the c.g. causes. Most off-center hits cause a tendency to rotate around both x and y axes. High $I_{xx}$ and $I_{yy}$ reduce the tendency to rotate and provide more forgiveness to off-center hits.

Inertia is also measured about the shaft axis ($I_{sa}$), shown in FIG. 1. First, the face of the club is set in the address position, then the face is squared and the loft angle and the lie angle are set before measurements are taken. Any golf ball hit has a tendency to cause the club head to rotate around the shaft axis. An off-center hit toward the toe would produce the highest tendency to rotate about the shaft axis, and an off-center hit toward the heel causes the lowest. High $I_{sa}$ reduces the tendency to rotate and provides more control of the hitting face. High $I_{xx}$, $I_{yy}$ and $I_{sa}$ have been achieved in high-end cast iron-type clubs. This can now be realized in high-end forged iron-type clubs in accordance with the present invention.

As discussed above, the hitting zone of the club head can be as thin as about 0.100 inch for a 2-iron and about 0.150 inch for a sand wedge (SW). The weight is moved to the perimeter of the club head, and the sole can be as thick as about 0.540 inch to about 0.780 inch and the top can be as thick as about 0.180 inch to about 0.380 inch, preferably about 0.240 inch to about 0.320 inch. Exemplary inertias of the inventive clubs calculated by computer aided design (CAD) are shown below and compared to the inertia of a traditional forged muscle back (with no perimeter weighting). The comparative clubs are the Titleist® 670 Forged Irons.

| CAD-generated | Inventive Oversize Clubs | | | Inventive Clubs | | | Comparative Clubs | | |
|---|---|---|---|---|---|---|---|---|---|
| Club type | 3 | 6 | 9 | 3 | 6 | 9 | 3 | 6 | 9 |
| I-xx (kg-mm$^2$) | 52.7 | 56.5 | 70.0 | 50.5 | 55.7 | 70.7 | 47.3 | 54.6 | 72.8 |
| I-yy | 234.8 | 244.8 | 270.3 | 228.0 | 240.5 | 264.7 | 189.3 | 202.4 | 238.9 |
| I-sa | 526.6 | 595.2 | 662.5 | 472.2 | 536.7 | 608.6 | 389.4 | 435.3 | 488.3 |
| CG-y (mm) | 18.6 | 18.5 | 18.7 | 18.3 | 18.4 | 18.7 | 19.6 | 19.7 | 19.6 |
| CG-sa | 37.8 | 37.6 | 37.6 | 34.8 | 35.8 | 36.1 | 32.1 | 32.2 | 31.6 |
| weight (kg) | 0.243 | 0.261 | 0.283 | 0.241 | 0.260 | 0.282 | 0.240 | 0.259 | 0.281 |

* data created from CAD files.

As discussed above, the relative large cavity volumes of the inventive oversize clubs produce high rotational moments of inertia, particularly $I_{sa}$ and $I_{yy}$.

The locations of the center of gravity are also listed above. GC-y is measure from the ground when the club rests in the address position; CG-x is measured from the center of the face in the same position; and CG-sa is measured from the shaft axis in the same position. The center of gravity is located behind and below the geometric center of hitting face. The geometric center can be defined as the midpoint of the grooves or score lines, as stated above. It is readily apparent that the moments of inertia of the inventive clubs are higher than the moments of inertia of the comparative clubs.

While it is apparent that the illustrative embodiments of the invention disclosed herein fulfill the objectives stated above, it is appreciated that numerous modifications and other embodiments may be devised by those skilled in the art. Therefore, it will be understood that the appended claims are intended to cover all such modifications and embodiments, which would come within the spirit and scope of the present invention.

We claim:

1. An iron-type golf club comprising:

a club head made from a forged metal having a hosel, a front and a back, wherein the back comprises a cavity defined by a perimeter member and the front has a hitting zone located opposite to and coinciding with the cavity, and wherein the cavity has a volume of greater than about 12 cc and wherein the rotational moment of inertia about a shaft axis is greater than about 500 kg·mm$^2$, wherein the perimeter member is thicker on the bottom of the club head than on the top.

2. The iron-type golf club of claim 1, wherein the rotational moment of inertia about the shaft axis is greater than about 550 kg·mm$^2$.

3. The iron-type golf club of claim 2, wherein the rotational moment of inertia about the shaft axis is greater than about 600 kg·mm$^2$.

4. The iron-type golf club of claim 1, wherein the forged metal is annealed.

5. The iron-type golf club of claim 4, wherein the metal is stainless steel.

6. The iron-type golf club of claim 5, wherein the stainless steel has a yield strength less than about 90,000 psi and an elongation of greater than about 13%.

7. The iron-type golf club of claim 6, wherein the yield strength is less than about 85,000 psi and the stainless steel has an ultimate elongation of about 15% to about 21%.

8. The iron-type golf club of claim 5, wherein the stainless steel comprises more than about 10% of chromium.

9. The iron-type golf club of claim 5, wherein the metal is selected from a group consisting of 410 stainless steel, 403 stainless steel, 431 stainless steel, 416 stainless steel, 303 stainless steel, 304 stainless steel, 329 stainless steel, 316 stainless steel, 259 stainless steel, Nitronic 40, Nitronie 50 and Nitronic 60.

10. The iron-type golf club of claim 4, wherein the grain size of the forged and annealed metal is greater than about 10 μm.

11. The iron-type golf club of claim 10, wherein the grain size of the forged and annealed metal is between about 10 μm and about 50 μm.

12. The iron-type golf club of claim 4, wherein the club head has a hardness of less than about 90 Rockwell Hardness B.

13. The iron-type golf club of claim 1, wherein the cavity is further adjoined by a first portion and a reinforced portion located on the back of the club head and wherein the reinforced portion is thicker than the first portion.

14. The iron-type golf club of claim 13, wherein the first portion is located on top of the reinforced portion.

15. The iron-type golf club of claim 13, wherein the thickness of the reinforced portion is about 1.2 times to about 3 times higher than the thickness of the first portion.

16. The iron-type golf club of claim 13, wherein the first portion occupies from about 50% to about 90% of the total area of the hitting zone.

17. The iron-type golf club of claim 16, wherein the first portion occupies from about 60% to about 80% of the total area of the hitting zone.

18. The iron-type golf club of claim 1, wherein the club head is a unitary club head.

19. The iron-type golf club of claim 1, wherein the club head further comprises a forged face insert, and wherein the face insert is made from the same metal as the club head.

20. The iron-type golf club of claim 1, wherein the club head further comprises a stamped face insert and wherein the face insert is made from the same metal as the club head.

21. The iron-type golf club of claim 1, wherein the club head is selected from a group consisting of the number 1–9 irons, the pitching wedge, the sand wedge and the gap wedge.

22. The iron-type golf club of claim 1, wherein the club head is attachable to a shaft and a grip.

23. The iron-type golf club of claim 1, wherein the hitting zone has a minimum thickness of less than about 0.2 inch.

24. The iron-type golf club of claim 23, wherein the minimum thickness is less than about 0.13 inch when the loft angle is less than about 35°.

25. The iron-type golf club of claim 23, wherein the minimum thickness is about 0.1 inch.

26. The iron-type golf club of claim 1, wherein the hitting zone has an ratio in accordance to the following equation:

$$\text{ratio} \geqq -((1/4.5) \times \text{loft angle}^\circ) + 25,$$

wherein the ratio is the area of the hitting zone ($\text{inch}^2$) divided by the minimum thickness (inch).

27. An iron-type golf club comprising a club head made from forged metal, said club head comprises a hosel, a front and a back defining a cavity, wherein the front comprises a hitting zone located opposite to the cavity and wherein the club is selected from the group consisting of a three iron having a cavity volume about equal to or greater than 11.75 $cm^3$, a four iron having a cavity volume about equal to or greater than 10.78 $cm^3$, a five iron having a cavity volume about equal to or greater than 10.45 $cm^3$, a six iron having a cavity volume about equal to or greater than 10.64 $cm^3$, a seven iron having a cavity volume about equal to or greater than 8.68 $cm^3$, a eight iron having a cavity volume about equal to or greater than 8.92 $cm^3$, or a nine iron having a cavity volume about equal to or greater than 9.10 $cm^3$.

* * * * *